US006966484B2

(12) United States Patent
Calonje et al.

(10) Patent No.: US 6,966,484 B2
(45) Date of Patent: Nov. 22, 2005

(54) MAILING AND RESPONSE ENVELOPE

(75) Inventors: Ligia S. Calonje, Los Gatos, CA (US); Roy Carrillo, Los Gatos, CA (US); Thomas R. Dillon, Los Gatos, CA (US); W. Reed Hastings, Los Gatos, CA (US); Gregory K. Stahl, Los Gatos, CA (US); W. Douglas Strabel, Los Gatos, CA (US); Gordon P. Rosete, Los Gatos, CA (US)

(73) Assignee: Netflix, Inc., Los Gatos, CA (US)

( * ) Notice: Subject to any disclaimer, the term of this patent is extended or adjusted under 35 U.S.C. 154(b) by 213 days.

(21) Appl. No.: 10/245,777

(22) Filed: Sep. 16, 2002

(65) Prior Publication Data

US 2004/0050919 A1 Mar. 18, 2004

(51) Int. Cl.[7] ..... B65D 27/06
(52) U.S. Cl. ..... 229/305
(58) Field of Search ..... 229/304, 305

(56) References Cited

U.S. PATENT DOCUMENTS

| | | | | |
|---|---|---|---|---|
| 2,928,583 A | | 3/1960 | Law | |
| 3,111,336 A | | 11/1963 | Schumacher | |
| 3,278,015 A | | 10/1966 | Bernstein | |
| 3,411,699 A | * | 11/1968 | Pine et al. | 229/69 |
| 3,472,444 A | | 10/1969 | Aliff, Jr. et al. | |
| 3,802,618 A | | 4/1974 | Wiessner | |
| 3,899,127 A | | 8/1975 | Melander | |
| 4,180,168 A | | 12/1979 | Hiersteiner | |
| 4,384,670 A | * | 5/1983 | Dicker | 229/69 |
| 4,487,360 A | | 12/1984 | Fisher et al. | |
| 4,653,639 A | | 3/1987 | Traynor | |
| 4,706,878 A | * | 11/1987 | Lubotta et al. | 229/304 |
| 4,878,613 A | * | 11/1989 | Badger et al. | 229/75 |
| 5,248,032 A | | 9/1993 | Sheu et al. | |
| 5,271,553 A | | 12/1993 | Kim | |
| 5,288,014 A | * | 2/1994 | Meyers et al. | 229/304 |
| 5,318,222 A | | 6/1994 | Bartlett | |
| 5,415,341 A | | 5/1995 | Diamond | |
| 5,458,273 A | | 10/1995 | Schubert et al. | |
| 5,487,826 A | | 1/1996 | Back et al. | |

(Continued)

FOREIGN PATENT DOCUMENTS

| | | |
|---|---|---|
| GB | 2 101 528 A | 1/1983 |
| GB | 2 117 319 A | 10/1983 |
| GB | 2 179 324 A | 3/1987 |
| WO | WO 98/28198 A1 | 7/1998 |
| WO | WO 00/10885 A1 | 3/2000 |

OTHER PUBLICATIONS

Digital Versatile Disk (DVD) prepared by Applicants depicting and describing certain mailer envelopes; each mailer envelope depicted therein is admitted to have been created prior to the filing date of the application; video recorded Feb. 25, 2003.

*Primary Examiner*—Jes F. Pascua
(74) *Attorney, Agent, or Firm*—Hickman Palermo Truong & Becker LLP

(57) ABSTRACT

A mailing and response envelope for conveying an item from a sender to a recipient and back is disclosed. The envelope comprises a base panel, a sender address panel, and a recipient address panel. The sender address panel is affixed to the base panel by an adhesive region. The sender address panel and adhesive region define a pocket sized to accept an item. The adhesive region extends laterally on the base panel in an amount selected to ensure that a postal cancellation is not applied to an area overlying the item. The recipient address panel is joined to the base panel by a detachable joint. In this configuration, a fragile item may be conveyed from the sender to the recipient and from the recipient back to the sender without damage to the item.

14 Claims, 8 Drawing Sheets

U.S. PATENT DOCUMENTS

| | | | | | |
|---|---|---|---|---|---|
| 5,516,040 | A | | 5/1996 | Lin | |
| 5,553,774 | A | * | 9/1996 | Goodno | 229/303 |
| 5,713,511 | A | | 2/1998 | Diamond | |
| 5,722,538 | A | | 3/1998 | Neely et al. | |
| 5,862,978 | A | | 1/1999 | Forrest | |
| 6,129,389 | A | | 10/2000 | Younger | |
| 6,173,888 | B1 | * | 1/2001 | Fabel | 229/71 |
| 6,402,022 | B1 | * | 6/2002 | Fabel | 229/303 |
| 6,409,075 | B1 | * | 6/2002 | Mehta et al. | 229/92.1 |
| 6,481,754 | B2 | * | 11/2002 | Fabel | 283/116 |
| 2002/0195484 | A1 | | 12/2002 | Raylings et al. | |
| 2003/0121962 | A1 | | 7/2003 | Hamblin | |

OTHER PUBLICATIONS

Netflix, Inc., Mailer Envelope version V14, dated 2001.

Netflix, Inc., Mailer Envelope version V15A, dated 2001.

Netflix, Inc., Mailer Envelope version V15B, dated 2001.

Netflix, Inc., Mailer Envelope version V18BBL, undated but admitted as created in 2001.

Netflix, Inc., Mailer Envelope version V17, dated 2001.

Netflix, Inc., Mailer Envelope version V18BUC with Tyvek® insert envelope, undated but admitted as created in 2001.

Netflix, Inc., Mailer Envelope version V19, dated 2001.

Netflix, Inc., Mailer Envelope version V19A, dated 2001.

Netflix, Inc., Mailer Envelope version V19Z, dated 2001.

Netflix, Inc., Mailer Envelope version V22, dated 2001.

Netflix, Inc., Mailer Envelope version V26, dated 2001.

* cited by examiner

MAILING AND RESPONSE ENVELOPE

FIELD OF THE INVENTION

The present invention generally relates to mailers and envelopes. The invention relates more specifically to a mailing and response envelope structured to protect a fragile item therein during both sending and returning the item.

BACKGROUND OF THE INVENTION

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

Combination envelopes that can carry an item from a sender to a recipient, and back to the sender, are used in several business contexts. For example, in the context of invoicing and payment, multiple-folded envelopes have been used in which an invoice is affixed by a perforation to a reply envelope. The invoice is folded over and sealed to form a closed sending envelope, and an adhesive strip is provided adjacent to the reply envelope. When the customer receives such an envelope or "piece," the customer opens the piece, detaches the invoice, inserts a check for payment in the reply envelope, affixes the adhesive strip, and dispatches the sealed reply envelope in the mail. The use of this past approach, however, has been limited to paper enclosures such as invoices and the like.

The development of the Digital Versatile Disc ("DVD") as a medium for carrying digital movie and video information has led to new rental business models that use postal mail for media transport. For example, Netflix, Inc., of Los Gatos, Calif., offers a DVD rental service in which a subscriber establishes an online "pick list" of DVD movies that the subscriber wishes to rent. When a selected one of the DVD movies on the pick list becomes available in inventory, Netflix mails the selected DVD movie to the subscriber. The subscriber views the DVD and returns it to Netflix by mail. When the DVD is received at Netflix, the subscriber is entitled to receive another available DVD from the pick list.

In this context, however, problems can be encountered as the DVD passes through the postal delivery system. The packaging used to convey the DVD from Netflix to the customer passes through high-speed automatic sorting equipment at postal facilities. Further, the packaging used to convey the DVD from the customer to Netflix passes through high-speed automatic cancellation equipment at postal facilities, during which a postal cancellation mark is applied to the packaging. Because DVDs are manufactured from relatively brittle plastic material, and because the cancellation marks are applied with considerable force, a percentage of DVDs passing through the postal system in this manner are subject to damage, breakage or mutilation.

Based on the foregoing, there is a clear need for a way to package a fragile or breakable item for transport in the postal system from one party to another party in a manner that protects the item from damage, breakage or mutilation.

Another problem in this context relates to convenience. Customers of rental approaches, such as the DVD approach described above, demand convenience. When an item is sent to the customer, the customer expects to receive some form of postpaid return packaging with the item. Sending the return packaging separately is not practical or convenient.

Accordingly, in this field there is a need for a packaging system in which a sending package and a return package are provided concurrently.

Still another issue involves the cost of the postage that is incurred in such a rental approach. The average weight of an item such as a DVD in a protective sleeve is approximately 0.58 ounces. Favorable postage rates are achieved when the total weight of the DVD, its protective sleeve, a sending package, and a return package are less than one ounce. Thus, there is a need for a packaging approach that solves all the foregoing problems and has an average weight less than one ounce.

Still another issue involves the cost of the packaging materials that are incurred. For a for-profit business engaged in the foregoing rental business, having packaging materials that satisfy all the foregoing requirements and have minimum cost is most desirable. Thus, there is a need for a packaging approach that solves all the preceding problems in a way that offers minimal cost.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENT

A mailing and response envelope is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Embodiments are described herein according to the following outline:

| | |
|---|---|
| 1.0 | General Overview |
| 2.0 | Mailing and Response Envelope |
| 2.1 | Embodiments with Adhesive-Reinforced Leading Edge |
| 2.2 | Embodiments with Perforated Access Strips |
| 2.3 | Embodiments with Removable Labels |
| 3.0 | Extensions and Alternatives |

1.0 General Overview

The needs identified in the foregoing Background, and other needs and objects that will become apparent for the following description, are achieved in the present invention, which comprises, in one aspect, an envelope for conveying an item from a sender to a recipient and back. The envelope comprises a base panel, a sender address panel, and a recipient address panel. The sender address panel is affixed to the base panel by an adhesive region. The sender address panel and adhesive region define a pocket sized to accept an item. The adhesive region extends laterally on the base panel in an amount selected to ensure that a postal cancellation is not applied to an area overlying the item. The recipient address panel is joined to the base panel by a detachable joint. In this configuration, a fragile item may be conveyed from a sender to a recipient and from the recipient back to the sender, without damage to the item.

Other aspects will become apparent from the following description.

2.0 Mailing and Response Envelope

2.1 Embodiments with Adhesive-Reinforced Leading Edge

Figure 1:
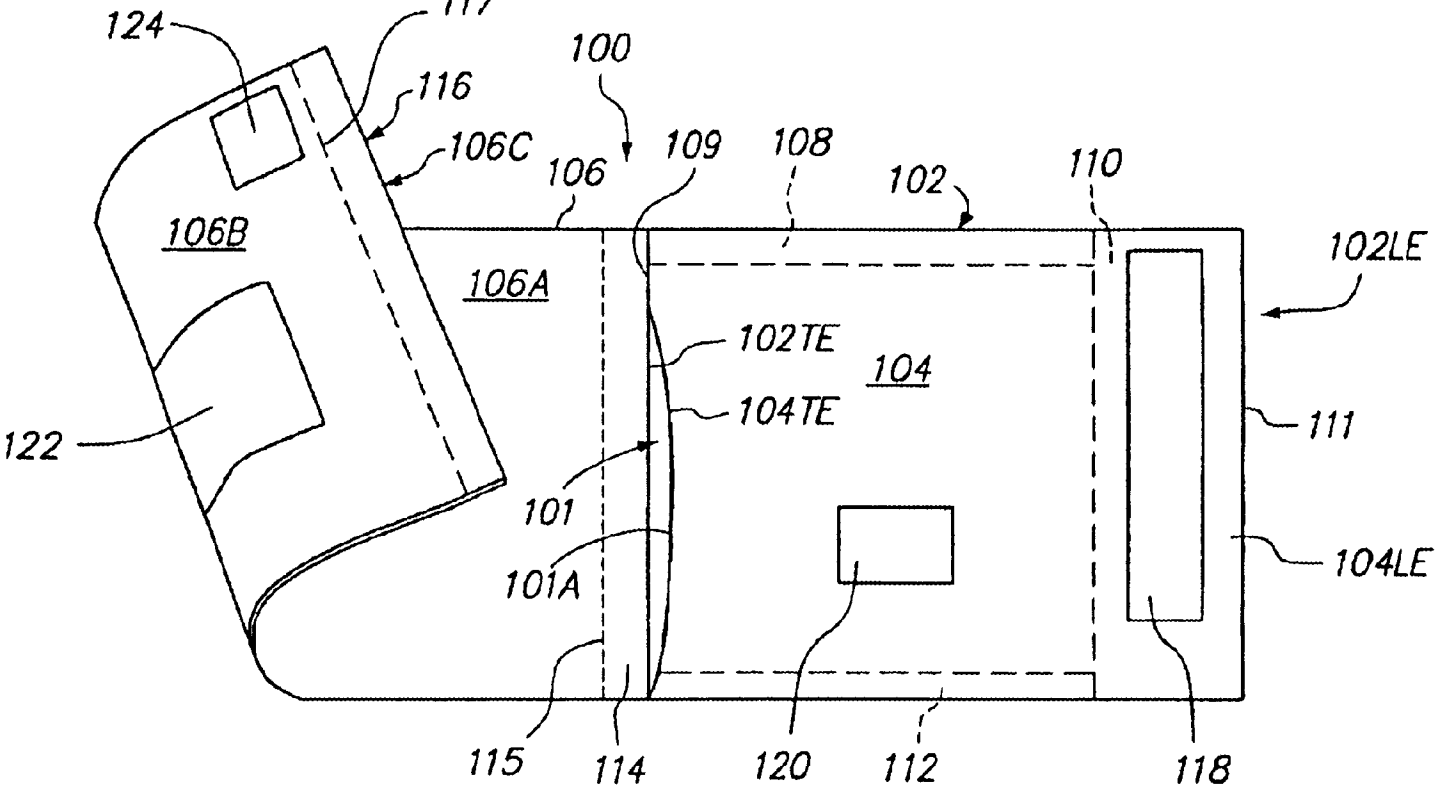
FIG. 1 is a top plan view of a mailing and response envelope.

FIG. 1 is a top plan view of a mailing and response envelope 100 comprising a base panel 102, sender address panel 104, and recipient address panel 106. Base panel 102 and sender address panel 104 each comprise a leading edge 102LE, 104LE, respectively, and a trailing edge 102TE, 104TE, respectively. In this context, "leading edge" refers to an edge that first enters an automatic postal processing machine as envelope 100 is processed by the machine, and "trailing edge" refers to an edge that last enters the machine.

Sender address panel 104 is affixed to base panel 102 by one or more adhesive regions 108, 110, 112. A top adhesive region 108 affixes a top edge of sender address panel 104 to a corresponding top edge of base panel 102. A bottom adhesive region 112 affixes a bottom edge of the sender address panel to a corresponding bottom edge of the base panel. A leading adhesive region 110 affixes leading edge 102LE of the base panel 102 to the leading edge 104LE of the sender address panel 104. Collectively, the sender address panel 104, base panel 102, and adhesive regions 108, 110, 112 define a pocket 101 having an open end 101A that may receive an item.

In one embodiment, panels 102, 104, 106 are made of paper, which may bear printed indicia in any form. For example, 50-pound Offset Grade, acid-free paper from Boise Cascade may be used. Alternatively, panels 102, 104, 106 may comprise plastic materials such as polyethylene, cardstock, etc. Adhesive regions 108, 110, 112 may comprise clear open pot mailer glue, such as No. 33-9215 from National, applied to a face of panel 102.

Base panel 102 joins recipient address panel 106 at a fold 109 and perforation 115 that define a first longitudinal sealing adhesive region 114. Sealing adhesive region 114 may have any appropriate adhesive medium for sealing the region 114 onto sender address panel 104, thereby to close pocket 101 when an item is sent back from a recipient to a sender. For example, in one embodiment, "Kleenstick" peel-and-stick adhesive, comprising a non-sticky removable layer over a sticky self-adhesive material, is used. Each of the perforations and folds described herein may function, additionally or alternatively, as a detachable joint.

Recipient address panel 106 has an inside face 106A and outside face 106B. A distal end 106C of inside face 106A is provided with a longitudinal perforation line 117 that defines a second longitudinal sealing adhesive region 116, which may have any appropriate adhesive medium for sealing the region 116 onto base address panel 102, thereby to close the entire envelope 100 when an item is sent from a sender to a recipient. For example, in one embodiment, "Kleenstik" peel-and-stick adhesive is used.

Perforations 115, 117 may be formed using seven perforation teeth per inch (7 TPI), as an example.

Outside face 106B of recipient address panel 106 is the face of the envelope 100 that is exposed to postal authorities or other shipment personnel when the envelope is conveyed from a sender to a recipient. Accordingly, outside face 106B may be printed with indicia relating to the recipient and postage or other elements relating to properly transporting the envelope 100. In one embodiment, a recipient address region 122 bears a label, printing or other indicia that identifies a postal address of the recipient, and a postage region 124 bears postage, or identifies a postage permit number, or provides an indication that the sender has prepaid postage due for sending the envelope 100 to the recipient.

Sender address panel 104 is the face of the envelope 100 that is exposed to postal authorities or other shipment personnel when the envelope is conveyed from a recipient back to a sender. Accordingly, panel 104 may be printed with indicia relating to the sender and postage or other elements relating to properly transporting the envelope 100. In one embodiment, a sender address region 120 bears a label, printing or other indicia that identifies a postal address of the sender, and a postage region 118 bears postage, or identifies a postage permit number, or provides an indication that the sender has prepaid postage due for sending the envelope 100 back to itself. Postage region 118 may bear a facing identification mark (FIM), barcode, or other postal service indicia that is readable by automatic handling equipment.

In manufacturing, panels 102, 106 may be formed as a continuous sheet that is folded at fold 109 using suitable folding equipment, and panel 104 may be glued down on panel 106 using a multi-web continuous assembly machine. Alternatively, panels 102, 104, 106 may be formed as a contiguous sheet that is folded at edge 111 and fold 109 using suitable folding equipment. Dimensions of panels 102, 104, 106 are not critical and may vary in different embodiments. In one embodiment that qualifies for transport by the United States Postal Service as "letter" mail, rather than as a "flat," the height of panels 102, 104, 106 as measured in an up-and-down direction in FIG. 1 is no more than 6", and each panel has an overall width of about 8⅛".

Figure 2A:
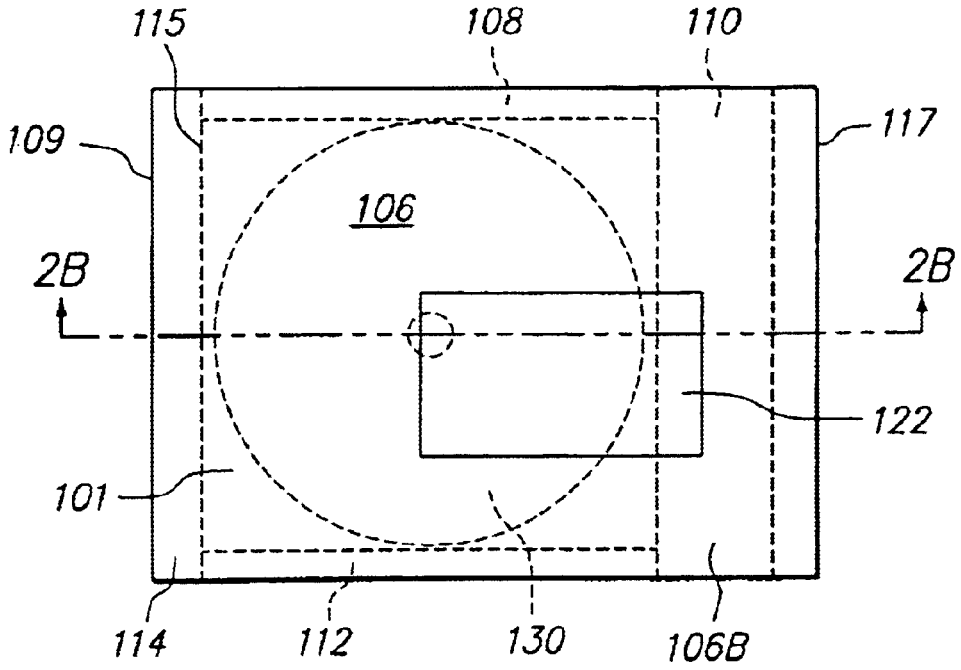
FIG. 2A is a top plan view of the envelope of FIG. 1 in a folded configuration for sending an item therein from a sender to an addressee.
Figure 2B:
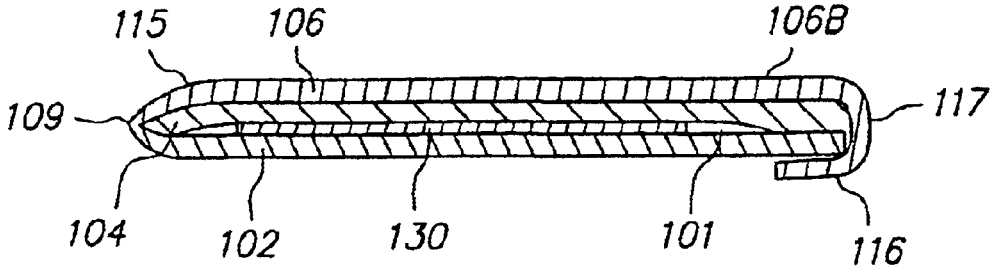
FIG. 2B is a section view of the envelope of FIG. 2A taken along line 2B—2B of FIG. 2A.

FIG. 2A is a top plan view of the envelope of FIG. 1 in a folded configuration for sending an item therein from a sender to an addressee. FIG. 2B is a section view of the envelope of FIG. 2A taken along line 2B-2B of FIG. 2A. In FIG. 2B, as well as in FIG. 3B, the thickness of panels is depicted in greatly exaggerated form, so that the relationship of panels in a folded configuration is clear.

In this configuration, an item 130 is carried in the pocket 101 defined by panels 102, 104. Panel 106 is folded at fold 109 over panel 104 such that outside face 106B is exposed to postal authorities or other methods of transport. Second adhesive region 116 is folded at perforation line 117 around and under panels 102, 104, such that the adhesive of the second adhesive region affixes panel 106 to panel 102. Optionally, in certain embodiments, additional adhesive may be applied on panel 104 before panel 106 is folded thereon, at approximately a lateral midline of panel 104, to provide additional adhesion to ensure that panel 106 lies fully flat over panel 104.

In folded and secured arrangement, the item may be conveyed from the sender to the recipient. Use of a relatively wide adhesive region 110 in this configuration has been found to substantially reduce breakage of a fragile item 130 within pocket 101. In particular, adhesive region 110 is typically aligned under an impact region associated with postal handling, processing, or cancellation equipment, but pocket 101 is aligned away from the impact region. As a result, any mechanical impact applied by the postal processing equipment strikes the adhesive region 110 and does not impact directly over the item in pocket 101. Further, by providing a relatively stiff laminated leading edge for envelope 100 that is less likely to jam in Postal Service mail processing equipment when the envelope is sent from sender to recipient.

Upon receipt, the recipient opens the envelope 100 by breaking perforation line 117. The recipient may then open panel 106 by moving it in a leftward direction with respect to FIG. 2A. The recipient may break perforation line 115 and discard panel 106. The recipient may remove the item 130 from pocket 101 by sliding it laterally outward in a leftward direction.

To return the item to the sender, the recipient re-inserts the item 130 into pocket 101. The recipient folds first adhesive region 114 on fold line 109 and seals the region to panel 104. The envelope 100 is then arranged as seen in FIG. 3A, FIG. 3B, and is ready for transport back to the sender.

Figure 3A:
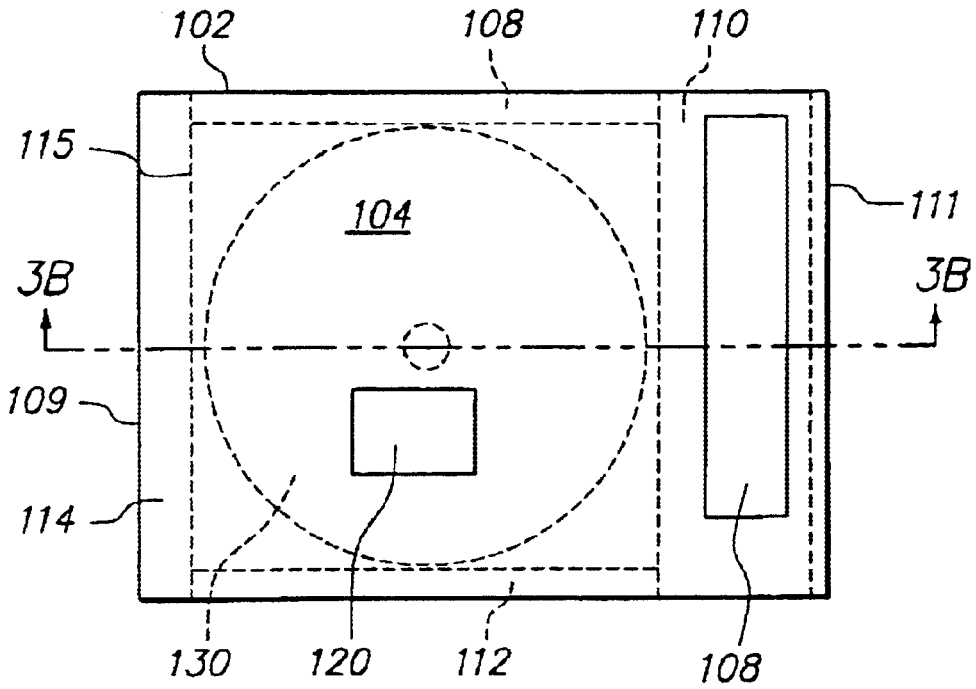
FIG. 3A is a top plan view of the envelope of FIG. 1 in a folded configuration for returning an item therein from an addressee to a sender.
Figure 3B:
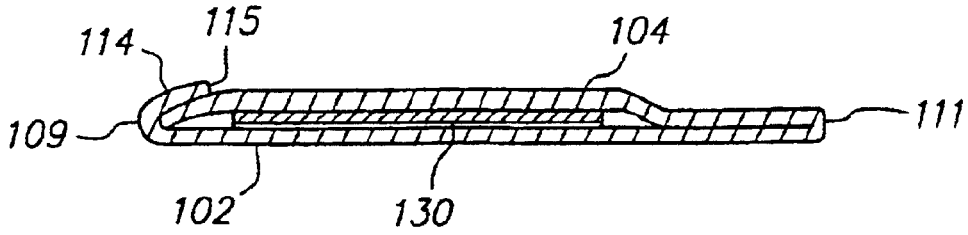
FIG. 3B is a section view of the envelope of FIG. 3A taken along line 3B—3B of FIG. 3A.

FIG. 3A is a top plan view of the envelope of FIG. 1 in a folded configuration for returning an item therein from an addressee to a sender. FIG. 3B is a section view of the envelope of FIG. 3A taken along line 3B—3B of FIG. 3A. In this arrangement, an item 130 is enclosed in pocket 101 as defined by panels 102, 104. First adhesive region 114 is folded at fold line 109 over panel 104 and its adhesive affixes to panel 104, so that panels 102, 104 form a closed envelope. Sender address indicia are visible to postal authorities or other transport equipment or personnel in sender address region 120. When a relatively wide adhesive region 110 is provided, an envelope 100 in this arrangement has been found to substantially reduce breakage of a fragile item 130 within pocket 101 by providing a relatively stiff laminated leading edge for the envelope.

Figure 4:
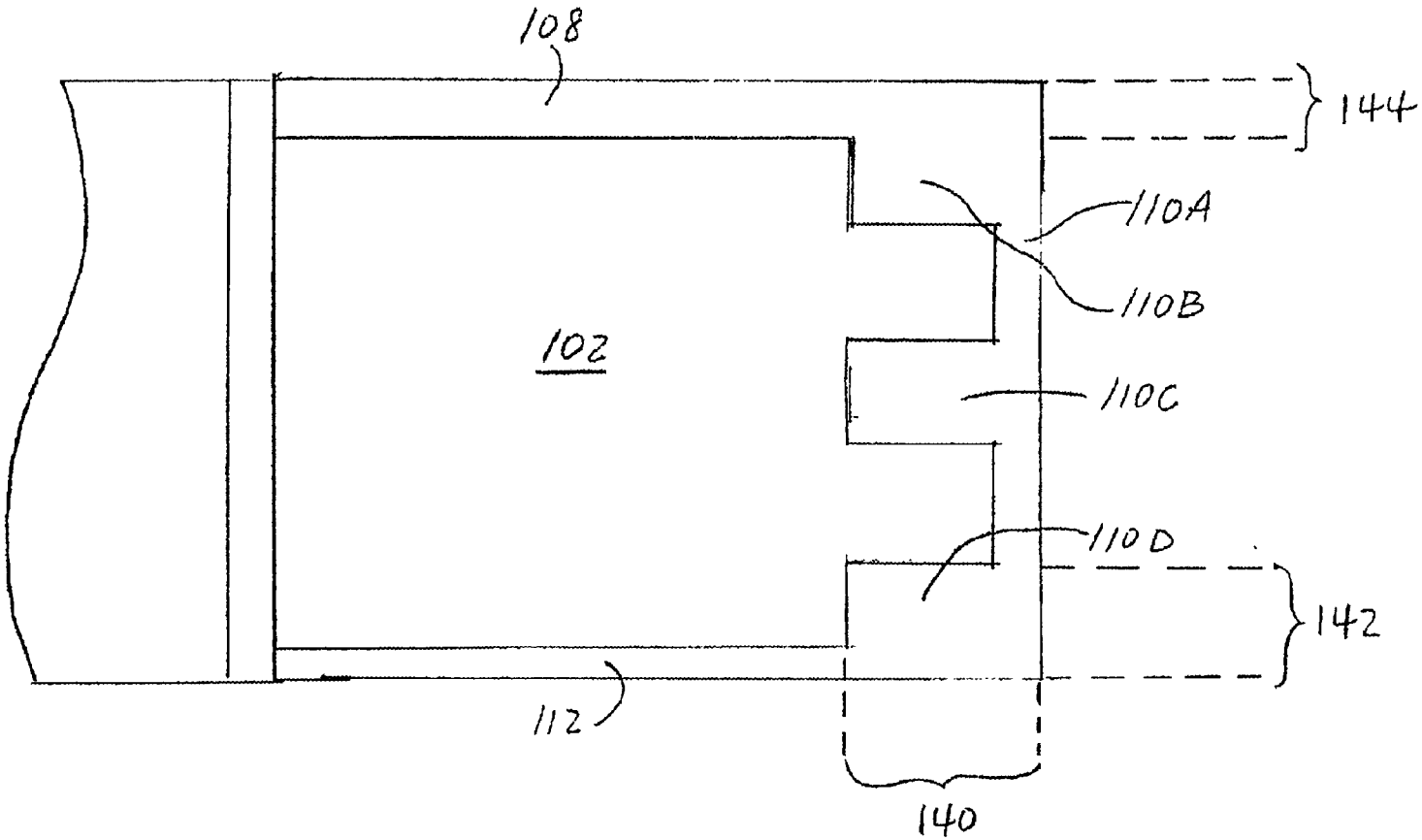
FIG. 4 is a top plan view of a bottom panel of the envelope of FIG. 1, illustrating an example adhesive configuration.

FIG. 4 is a top plan view of a bottom panel of the envelope of FIG. 1, illustrating an example adhesive configuration.

In one example embodiment, the pocket 101 is sized to receive a generally planar media item such as a Digital Versatile Disk (DVD), Compact Disk (CD), CD-ROM, etc. In this embodiment, panels 102, 104 have overall length dimensions of approximately 8" and overall width dimensions of 6", adhesive regions 108, 112 have width dimensions of approximately ¼" to ⅜", and adhesive region 110 extends laterally inward from edge 111 by approximately 3".

The dimension of 3" has been found appropiiate to ensure that postal processing equipment, some of which apply a cancellation stamp by using firm, mechanical pressure up to 3⅜" from the right edge of an envelope, does not impact a region directly over a disk media item carried in pocket 101. Thus, the adhesive region 110 and panels 102, 104 cooperate to form a leading edge that clears an impact region associated with a postal processing machine. Similarly, the dimensions of the adhesive regions 108, 110, 112 have been found appropriate to ensure that the postal cancellation does not directly impact the disk media item, by providing a top clearance of about 1³⁄₁₆". In this arrangement, pocket 101 may have an approximate size of 5.125"×5.375", as an example.

As seen in FIG. 4, adhesive region 110 may be formed as a plurality of distinct adhesive sub-regions, for reducing the amount of adhesive required per envelope without detracting from the stiffness property provided by the presence of adhesive. In one embodiment, a generally elongated first adhesive sub-region 110A connects three other adhesive sub-regions 110B, 110C, 110D. The drawing of FIG. 4 is not to scale and the dimensions therein are approximate. In one embodiment, each adhesive sub-region 110B, 110C, 110D has a lateral width 140 of approximately 3" and a height 142 of approximately 1". The first adhesive sub-region 110A may be approximately ⅜" in width.

In alternative arrangements, more or fewer adhesive sub-regions in different configurations may be used. For example, the adhesive sub-regions need not be contiguous with corners of panel 102, as they are in FIG. 4. In one alternative embodiment, the adhesive sub-regions 110B, 110C, 110D may be disposed in a spaced-apart region along first adhesive sub-region 110A.

Adhesive regions 108, 110, 112 may be contiguous, as in FIG. 4. Adhesive sub-regions 110A, 110C, 110D may be formed contiguously with adhesive region 110. Alternatively, the adhesive regions or sub-regions are applied in a non-contiguous configuration.

The selection of the form and arrangement of adhesive regions may relate to an amount of postage that a business sender is willing to pay when sending envelopes 100 to recipients. For example, an envelope 100 in the configuration of FIG. 1–FIG. 4 is expected to have an approximate weight of 0.275 ounces; when an item is placed in the envelope, it is desirable in some embodiments for the item and envelope to weigh less than one ounce in total, so that extra postage does not apply. The amount of adhesive used for the adhesive regions can determine whether an envelope and item weigh more than one ounce.

Use of a relatively wide adhesive region 110 in this configuration has been found to substantially reduce breakage of a fragile item 130 within pocket 101. The region 110 provides a relatively stiff laminated leading edge for envelope 100 that is less likely to jam in postal processing equipment when the envelope is sent either from sender to recipient or from recipient to sender. While the exactly lateral width of adhesive region 110 is not critical, a width of approximately 3" has been found to yield superior results.

In other embodiments, the pocket 101 may accommodate other items and have other configurations.

In another alternative embodiment, recipient address indicia of recipient address region 122 is printed in an inverted orientation with respect to indicia in sender address region 122. Further, the position of postage region 124 is inverted both laterally and longitudinally so that it is properly oriented with respect to the new orientation of recipient address region 122. In this arrangement, when envelope 100 is transported in sealed form from sender to recipient, adhesive region 110 forms a trailing edge of the envelope. However, when envelope 100 is transported back from recipient to sender, adhesive region 110 forms a leading edge of the envelope.

This arrangement has been found useful in further reducing breakage of fragile media items that are carried from sender to recipient and back again. The arrangement is believed to provide good results because a different kind of postal inspection, processing and cancellation equipment is used to handle mail directed from a business sender to an individual recipient than for mail directed from an individual recipient back to the business.

2.2 Embodiments with Perforated Access Strips

Figure 5A:
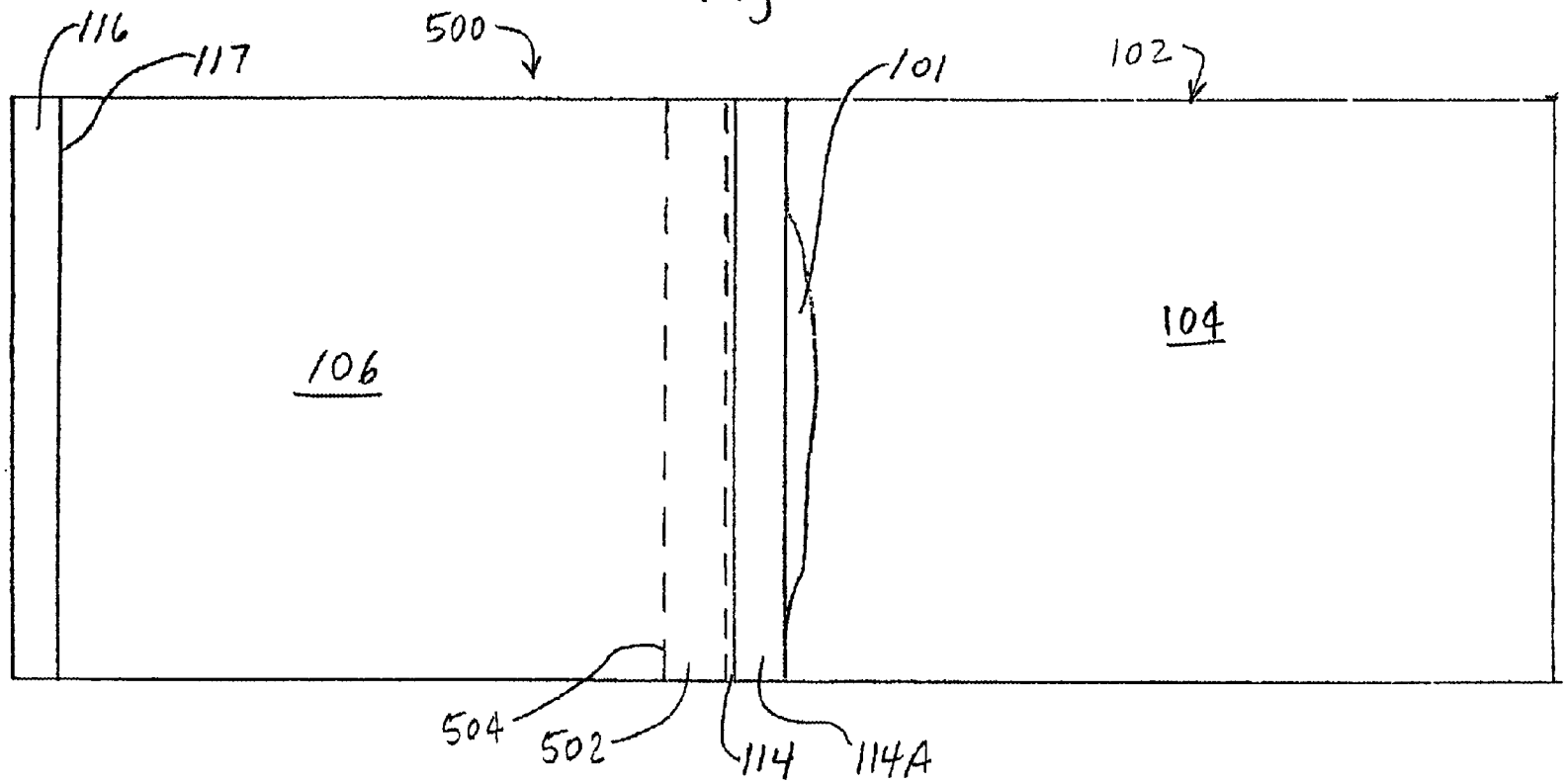
FIG. 5A and FIG. 5B depict an alternate embodiment of a mailing and response envelope.
Figure 5C:
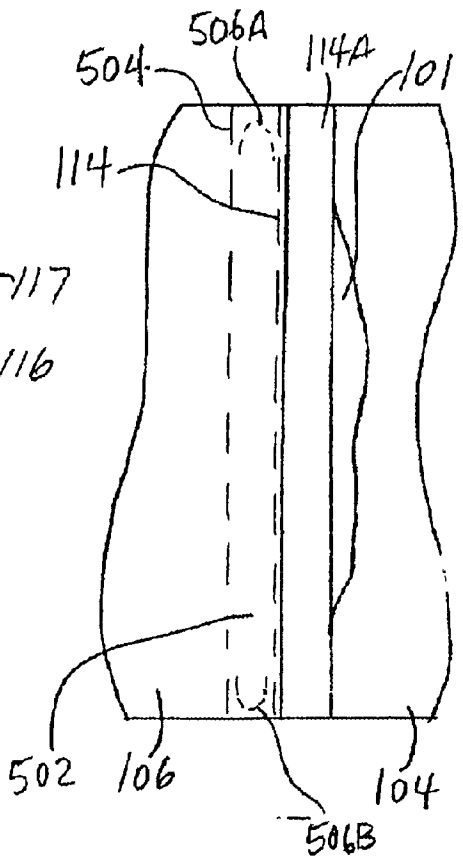
FIG. 5C is a top plan view of yet another alternative embodiment of a mailing and response envelope.
Figure 5B:
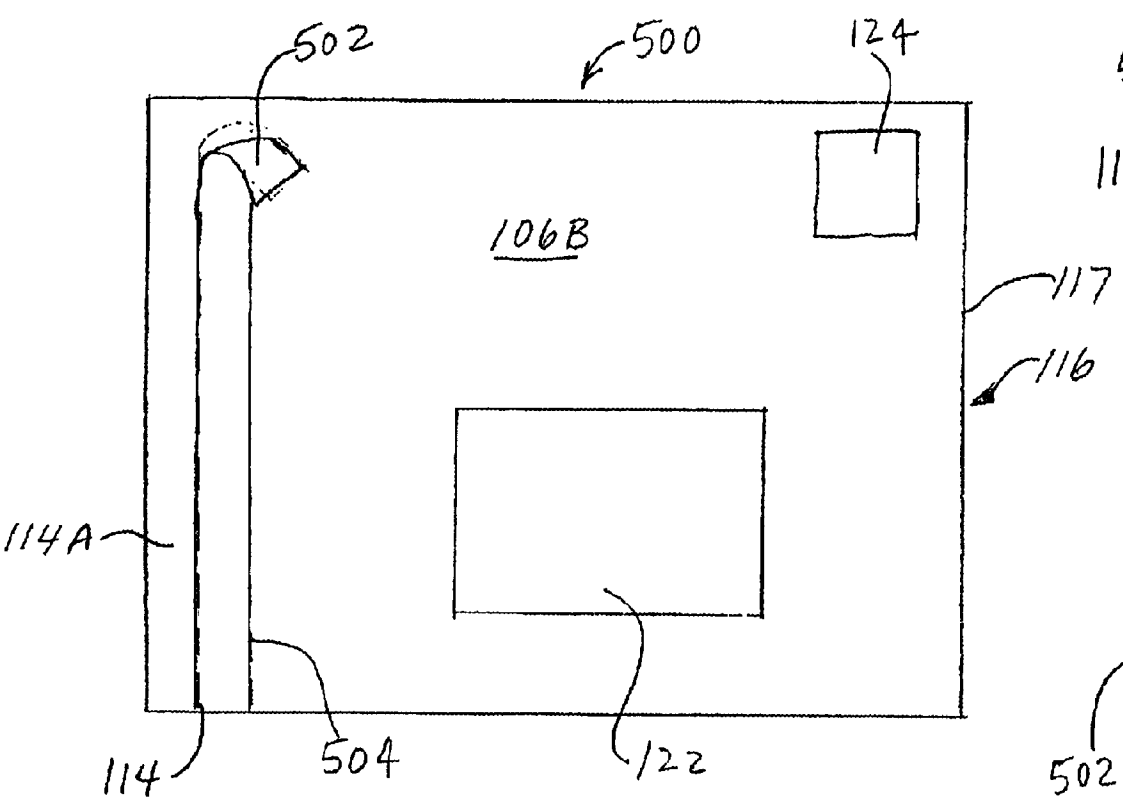

FIG. 5A and FIG. 5B depict an alternate embodiment of a mailing and response envelope 500. Referring first to FIG. 5A, panels 104, 106 are joined by a perforated strip 502 that is defined by a first perforation line 114 and a second perforation line 504. The envelope 500 is prepared for sending to a recipient by folding panel 106 onto panel 104 and affixing it thereto using the adhesive of adhesive region 116. Upon receipt, a recipient may open the envelope 500 by pulling upward or downward on a portion of strip 502, as shown in FIG. 5B until the strip is entirely removed. The recipient may then open panel 106 by moving it in a rightward direction with respect to FIG. 5B. Such action exposes panel 104 and pocket 101, from which the recipient may remove the item.

After using the item, the recipient may send the item back to the sender in the same manner as described above with respect to FIG. 1–FIG. 4.

FIG. 5C is a top plan view of yet another alternative embodiment of a mailing and response envelope 500. In this embodiment, strip 502 has one or more perforated tabs formed at the top and bottom of the strip, to facilitate a recipient grasping and pulling on the strip. For example, strip 502 comprises top and bottom curved or arcuate perforations 506A, 506B. A recipient may pull or pick at either of the perforations 506A, 506B until it separates from panel 106, and then grasp and pull the perforation so that all of strip 502 tears on perforations 114, 504.

2.3 Embodiments with Removable Labels

Figure 6A:
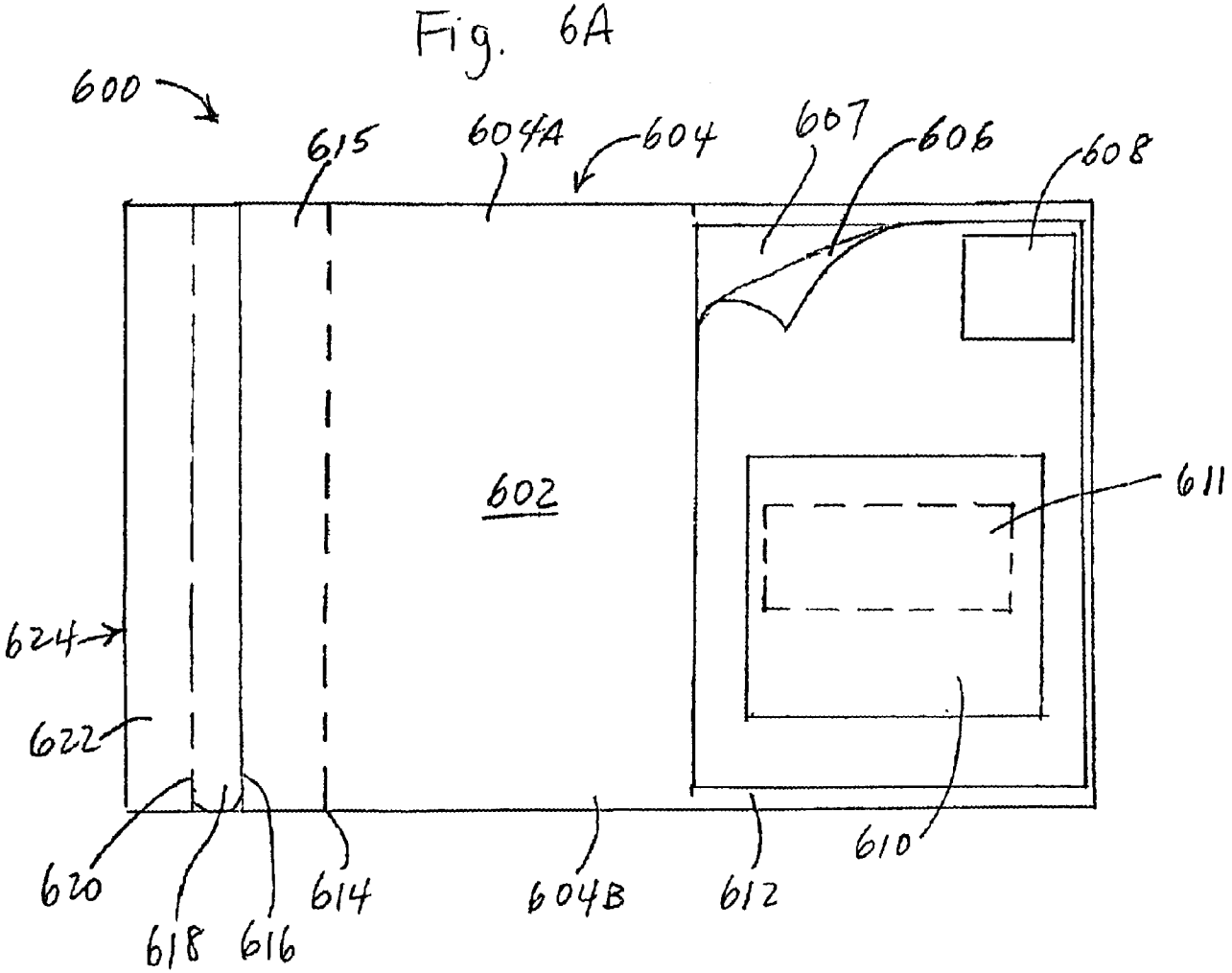
FIG. 6A is a top plan view of an envelope having a removable label feature.

FIG. 6A is a top plan view of an envelope having a removable label feature.

Envelope 600 comprises a top panel 602 and a bottom panel 604. A removable label 606 is carried on an underlying backing 607 that is affixed to top panel 602. The label 606 is printed with recipient address indicia in a recipient address region 610. A sending postage region 608 receives sending postage, a printed postage paid designation, or other indicia relating to conveying the envelope 600. A sender's address region 611 is provided on the backing 607 underlying the label 606 and is printed with a sender's address.

Panels 602, 604 are affixed to one another by adhesive strips along the upper edge 604A and lower edge 604B thereof, and by a planar region of adhesive 612 oriented below the label 606. In this configuration, panels 602, 604 form a pocket having a leading edge that is made relatively stiff by adhesive 612, and having an open end underlying perforation line 614. An item for transport from a sender to a recipient and back from the recipient to the sender may be carried in the pocket.

Envelope 600 further comprises a return sealing strip 615, removable access strip 618, and sending sealing strip 622, all of which may be formed integrally with top panel 602 and extend laterally outwardly from the top panel. Return sealing strip 615 is joined to top panel 602 by a first perforation line 614 and is further defined by a second perforation line 616. An underside of return sealing strip 615 is provided with return sealing adhesive (not shown), such as a peel-and-stick type of adhesive.

Removable access strip 618 is defined by second perforation line 616 and by a third perforation line 620 that adjoins the sending sealing strip 622. An underside 624 of sending sealing strip is provided with sending sealing adhesive (not shown), such as peel-and-stick adhesive.

Figure 6B:
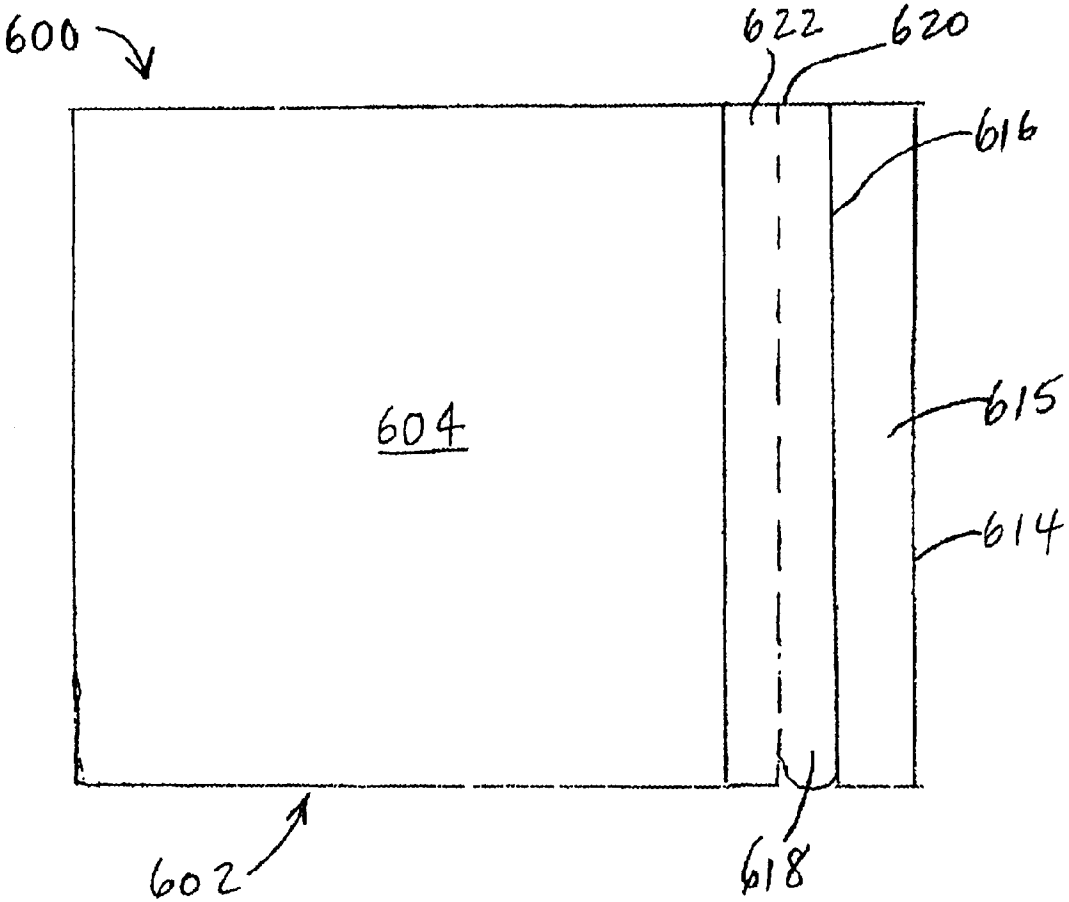
FIG. 6B is a bottom plan view of the envelope of FIG. 6A in a folded arrangement such that the envelope contains an item and is ready for sending from a sender to a recipient.

FIG. 6B is a bottom plan view of the envelope of FIG. 6A in a folded arrangement such that the envelope contains an item and is ready for sending from a sender to a recipient. The return sealing strip 615, removable access strip 618, and sending sealing strip 622 are folded as a unit at perforation line 114 into a position overlying bottom panel 604. The sending sealing adhesive is affixed to bottom panel 604. However, the return sealing adhesive underlying return sealing strip 615 is not affixed.

In this arrangement, envelope 600 may be sent from a sender to a recipient with an item in the pocket. Upon receipt, the recipient pulls removable access strip 618 upward, tearing it away from the envelope along perforations lines 616, 620. The recipient may then fold return sealing strip 615 away, thereby exposing the open end of the pocket, and may remove the item in the pocket by sliding it laterally outward, in a direction to the right in FIG. 6B.

To return the item to the sender, the recipient places the item back in the pocket by sliding it laterally inward. The return sealing adhesive is activated, for example, by peeling off its non-stick cover layer, and the return sealing strip 615 is then sealed to bottom panel 604. Referring again to FIG. 6A, the label 606 is then removed by peeling it away from the underlying backing 607 and discarding the label. Such action exposes the sender's address of region 611 on backing 607. In one embodiment, backing 607 also bears an indication that the envelope is postpaid for transport back to the sender, or postage. The recipient may then deposit the envelope into the postal system, or other system, for transport back to the sender.

3.0 Extensions and Alternatives

In the foregoing specification, the invention has been described with reference to specific embodiments thereof. It will, however, be evident that various modifications and changes may be made thereto without departing from the broader spirit and scope of the invention. For example, while certain embodiments are described with reference to requirements of postal authorities, the U.S. Postal Service, or any other method or mechanism for conveying an item between a sender and recipient may be used. The specification and drawings are, accordingly, to be regarded in an illustrative rather than a restrictive sense.

What is claimed is:

1. An envelope for conveying an item from a sender to a recipient and back, comprising:

a base panel having a leading edge and a trailing edge;

a sender address panel affixed to the base panel by an adhesive region that extends laterally inward from a leading edge of the base panel;

wherein the adhesive region, base panel and sender address panel collectively form a relatively rigid leading edge, the adhesive region having a width dimension that aligns the adhesive region under all of an impact region of a processing machine and that aligns all of a pocket away from the impact region, wherein the base panel, sender address panel and a portion of the adhesive region define the pocket for an item; and a recipient address panel joined to the trailing edge of the base panel by a detachable joint.

2. An envelope as recited in claim 1, further comprising means for sealing the recipient address panel over the sender address panel to form a closed envelope that may carry a response item.

3. An envelope as recited in claim 1, wherein the adhesive region comprises a plurality of sub-adhesive regions.

4. An envelope as recited in claim 1, wherein the adhesive region extends laterally from a leading edge of the base panel by about three inches (3").

5. An envelope as recited in claim 1, wherein the adhesive region comprises a top adhesive region that seals top edges of the base panel and sender address panel, a bottom adhesive region that seals bottom edges of the base panel and sender address panel, and a leading adhesive region that seals leading edges of the base panel and sender address panel.

6. An envelope as recited in claim 1, wherein the sender address panel, base panel and adhesive region define a pocket sized to accept a disk media item.

7. An envelope as recited in claim 1, wherein the sender address panel and adhesive region define a pocket sized to accept a digital versatile disk (DVD).

8. An envelope as recited in claim 1, wherein the base panel is substantially rectangular.

9. An envelope as recited in claim 1, further comprising means for sealing the pocket when the recipient address panel is detached.

10. An envelope as recited in claim 1, wherein the detachable joint is a perforation line.

11. An envelope as recited in claim 1, wherein the recipient address panel further comprises a detachable joint adjacent to a sealing means that enables opening the recipient address panel, when the recipient address panel is sealed to the sender address panel, to obtain access to the item.

12. An envelope as recited in claim 1, wherein a recipient address is imprinted on the recipient address panel.

13. An envelope as recited in claim 1, wherein a sender address is imprinted on the sender address panel.

14. An envelone for conveying a Digital Versatile Disk (DVD) from a sender to a recipient and back, comprising:

a base panel having a leading edge and a trailing edge;

a sender address panel affixed to the base panel by an adhesive region that extends laterally inward from a leading edge of the base panel;

wherein the base panel, sender address panel and a portion of the adhesive region define a pocket for carrying a DVD;

wherein the adhesive region, base panel and sender address panel collectively form a relatively rigid leading edge, the adhesive region having a width dimension of approximately three inches (7.5 cm) that aligns the adhesive region under all of an impact region of a processing machine and that aligns all of the pocket and any DVD therein away from the impact region; and a recipient address panel joined to the trailing edge of the base panel by a detachable joint.

* * * * *